US010881261B2

(12) United States Patent
Liang et al.

(10) Patent No.: US 10,881,261 B2
(45) Date of Patent: Jan. 5, 2021

(54) CLEANING ROBOT

(71) Applicant: Shenzhen Silver Star Intelligent Technology Co., Ltd., Guangdong (CN)

(72) Inventors: Feidu Liang, Shenzhen (CN); Changtai Xia, Shenzhen (CN)

(73) Assignee: SHENZHEN SILVER STAR INTELLIGENT TECHNOLOGY CO., LTD., Shenzhen (CN)

( * ) Notice: Subject to any disclaimer, the term of this patent is extended or adjusted under 35 U.S.C. 154(b) by 297 days.

(21) Appl. No.: 16/148,181

(22) Filed: Oct. 1, 2018

(65) Prior Publication Data

US 2019/0290091 A1 Sep. 26, 2019

(30) Foreign Application Priority Data

Mar. 22, 2018 (CN) ..... 2018 1 0239055

(51) Int. Cl.
*A47L 11/40* (2006.01)
*A47L 11/24* (2006.01)

(52) U.S. Cl.
CPC ..... *A47L 11/4044* (2013.01); *A47L 11/24* (2013.01); *A47L 11/4066* (2013.01); *A47L 2201/00* (2013.01)

(58) Field of Classification Search
CPC .. A47L 11/4044; A47L 11/24; A47L 11/4066; A47L 2201/00
See application file for complete search history.

*Primary Examiner* — Andrew A Horton
(74) *Attorney, Agent, or Firm* — Mai-Tram D. Lauer; Westman, Champlin & Koehler, P.A.

(57) ABSTRACT

A cleaning robot including a body, a driving assembly for driving the cleaning robot to move, and a first cleaning assembly for cleaning a floor is disclosed. The first cleaning assembly includes a rotating shaft, mounting members mounted at both ends of the rotating shaft, a brush body provided outside the rotating shaft, and the rotating shaft is rotatable along with rotation of the mounting member, driving the brush body to clean the floor. The brush body includes a soft bag of an internal hollow structure and a brush portion extending outward from a surface of the soft bag, such that during cleaning, elastic space of the first cleaning assembly is increased, and a frictional force between the first cleaning assembly and the floor is reduced, thereby effectively protecting the floor and increasing the service life of the first cleaning assembly.

20 Claims, 6 Drawing Sheets

CLEANING ROBOT

CROSS REFERENCE TO RELATED APPLICATIONS

This application claims priority to Chinese Patent Application No. CN2018102390556, filed on Mar. 22, 2018 with the State Intellectual Property Office of the People' Republic of China and entitled "Cleaning Robot", the contents of which are herein incorporated by reference in their entirety.

TECHNICAL FIELD

The present disclosure relates to the field of intelligent home service robots, and in particular to a cleaning robot.

BACKGROUND ART

A cleaning robot is one of intelligent home service robots, which, with certain artificial intelligence, can fulfill cleaning operations for home hygiene such as sweeping and washing. With the cleaning robot, cleaning objects such as garbage, dust and debris on a floor are pushed to a suction port by a first cleaning assembly, and are sucked into a cleaning object collecting box by a fan in the cleaning object collecting box.

The first cleaning assembly in the prior art mainly includes a pure wool brush, a pure rubber brush, a brush of mixed wool and rubber, and a roller-elastic brush. However, as the first cleaning assembly, the pure wool brush fails to contact the floor very well, resulting in poor air tightness of the suction port and a reduction in cleaning effects. Moreover, affected by the hardness of the material, the pure wool brush or the pure rubber brush is liable to scratch or damage a hard floor to some extent, especially a floorboard. There is also a roller-elastic brush in the prior art, which improves the air tightness due to the elasticity of its own material. However, with certain elasticity of the material itself, during cleaning, the roller-elastic brush constantly rubs against the floor to be cleaned, and since there is a different pressure between a different floor material and the first cleaning assembly, it is difficult for the roller-elastic brush, with the elasticity of the material itself, to adapt different pressures of the floor materials, resulting in a reduction in service life.

SUMMARY

An embodiment of the present disclosure provides a cleaning robot, comprising:

a body;

a driving assembly provided in the body and configured for driving the cleaning robot to move;

a cleaning object collecting box mounted in the body, in communication with a suction port of the body, and configured for collecting a cleaning object; and a first cleaning assembly mounted in the body and configured for cleaning a floor;

wherein the first cleaning assembly comprises a rotating shaft, mounting members mounted at two ends of the rotating shaft, and a brush body provided outside the rotating shaft, wherein the brush body comprises a brush portion and a soft bag, wherein the soft bag is deformable according to a force condition of the brush portion, and the rotating shaft is rotatable along with rotation of the mounting members, driving the brush body to sweep the cleaning object on the floor to the suction port.

An embodiment of the present disclosure provides a cleaning robot, comprising:

a body;

a driving assembly provided in the body and configured for driving the cleaning robot to move;

a cleaning object collecting box mounted in the body, in communication with a suction port of the body, and configured for collecting a cleaning object; and a first cleaning assembly mounted in the body and configured for cleaning a floor, wherein the first cleaning assembly comprises a rotating shaft, mounting members mounted at two ends of the rotating shaft, and a brush body and a bristle provided outside the rotating shaft, the brush body comprises a brush portion and a soft bag, wherein the soft bag is deformable according to a force condition of the brush portion, and the rotating shaft is rotatable along with rotation of the mounting members, driving the brush body and the bristle to sweep the cleaning object on the floor to the suction port.

An embodiment of the present disclosure provides a cleaning robot, comprising:

a body;

a driving assembly provided in the body and configured for driving the cleaning robot to move;

a cleaning object collecting box mounted in the body, in communication with a suction port of the body, and configured for collecting a cleaning object; and a first cleaning assembly mounted in the body and configured for cleaning a floor, wherein the first cleaning assembly comprises a first rotating shaft, a second rotating shaft, mounting members mounted at two ends of the first rotating shaft and the second rotating shaft, and a brush body provided in one of the two rotating shafts and a bristle provided in the other one of the two rotating shafts, the brush body comprises a brush portion and a soft bag, the soft bag is deformable according to a force condition of the brush portion, and the rotating shaft is rotatable along with rotation of the mounting members, driving the brush body and the bristle to sweep a cleaning object on the floor to the suction port.

BRIEF DESCRIPTION OF DRAWINGS

In order to more clearly illustrate the technical solutions of the examples of the present disclosure or in the prior art, brief description is made below on the drawings required to be used in the description of the examples or the prior art. Obviously, the drawings in the following description only illustrate some of the examples of the present disclosure, and for those of ordinary skills in the art, other variations may be obtained from these drawings without inventive efforts.

DETAILED DESCRIPTION OF EMBODIMENTS

Figure 1:
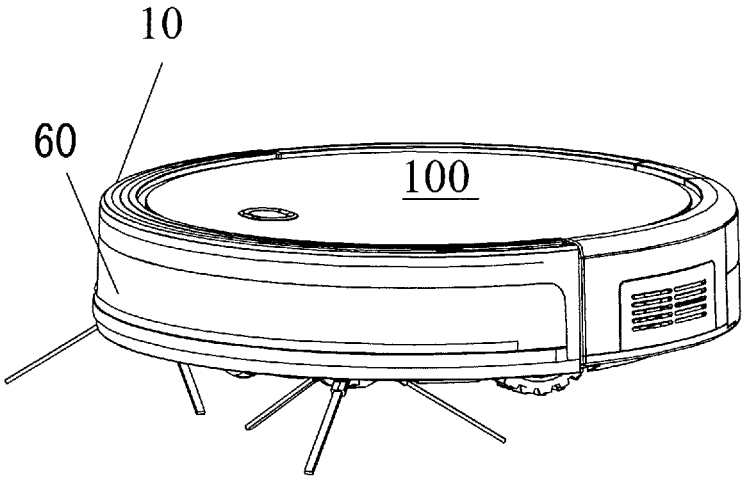
FIG. 1 is a perspective view of a cleaning robot in a first embodiment of the present disclosure.

The technical problem to be solved by the present disclosure is to provide a cleaning robot, where a frictional force between a first cleaning assembly and a floor can be reduced during cleaning, with the elastic space of the first cleaning assembly of the cleaning robot increased.

In order to solve the above technical problem, embodiments of the present disclosure employ the following technical solutions:

In one aspect, an embodiment of the present disclosure provides a cleaning robot, comprising:

a body;

a driving assembly provided in the body and configured for driving the cleaning robot to move;

a cleaning object collecting box mounted in the body, in communication with a suction port of the body, and configured for collecting a cleaning object; and a first cleaning assembly mounted in the body and configured for cleaning a floor;

wherein the first cleaning assembly comprises a rotating shaft, mounting members mounted at two ends of the rotating shaft, and a brush body provided outside the rotating shaft, wherein the brush body comprises a brush portion and a soft bag, wherein the soft bag is deformable according to a force condition of the brush portion, and the rotating shaft is rotatable along with rotation of the mounting members, driving the brush body to sweep the cleaning object on the floor to the suction port.

In an embodiment, the brush portion comprises a plurality of brush portions, and the soft bag is provided between the brush portions and the rotating shaft.

In an embodiment, the soft bag is any one of an air bag and an internal hollow structure.

In an embodiment, the plurality of brush portions are blades extending outward from an outer surface of the soft bag, and the soft bag is formed integrally with the plurality of brush portions.

In an embodiment, the soft bag comprises a plurality of bag portions, and each of the bag portions is combined with at least one brush portion of the brush portions.

In an embodiment, each of the bag portions is provided with an opening, a surface of the rotating shaft is provided with a channel, and the each of the bag portions is combined with the channel of the rotating shaft through at least partial edge of the opening, such that the soft bag and the rotating shaft form into one piece.

In an embodiment, the channel is of a linear type, an oblique type or a curved type, and an outer shape of the soft bag is a linear shape, an oblique shape or a curved shape after the opening of the corresponding bag portion cooperates with the channel.

In an embodiment, the plurality of bag portions are connected or not connected with each other.

In an embodiment, the brush body is an elastic member.

In an embodiment, each of the mounting members comprises a fixing member and a transmission member, the fixing member is sleeved at one end of the transmission member, and the end of the transmission member sleeved with the fixing member is connected with a motor mounted inside the body, and the other end of the transmission member is connected with the rotating shaft to drive the first cleaning assembly to rotate to clean the floor.

In second aspect, an embodiment of the present disclosure provides a cleaning robot, comprising:

a body;

a driving assembly provided in the body and configured for driving the cleaning robot to move;

a cleaning object collecting box mounted in the body, in communication with a suction port of the body, and configured for collecting a cleaning object; and a first cleaning assembly mounted in the body and configured for cleaning a floor, wherein the first cleaning assembly comprises a rotating shaft, mounting members mounted at two ends of the rotating shaft, and a brush body and a bristle provided outside the rotating shaft, the brush body comprises a brush portion and a soft bag, wherein the soft bag is deformable according to a force condition pf the brush portion, and the rotating shaft is rotatable along with rotation of the mounting members, driving the brush body and the bristle to sweep the cleaning object on the floor to the suction port.

In an embodiment, the soft bag is provided between the brush portion and the rotating shaft, a surface of the rotating shaft is provided with a channel configured for mounting the brush body and a slot configured for mounting the bristle, and the channel and the slot are provided side by side such that the brush body and the bristle are mounted side by side into the rotating shaft.

In third aspect, an embodiment of the present disclosure provides a cleaning robot, comprising:

a body;

a driving assembly provided in the body and configured for driving the cleaning robot to move;

a cleaning object collecting box mounted in the body, in communication with a suction port of the body, and configured for collecting a cleaning object; and a first cleaning assembly mounted in the body and configured for cleaning a floor, wherein the first cleaning assembly comprises a first rotating shaft, a second rotating shaft, mounting members mounted at two ends of the first rotating shaft and the second rotating shaft, and a brush body provided in one of the two rotating shafts and a bristle provided in the other one of the two rotating shafts, the brush body comprises a brush portion and a soft bag, the soft bag is deformable according to a force condition of the brush portion, and the rotating shaft is rotatable along with rotation of the mounting members, driving the brush body and the bristle to sweep a cleaning object on the floor to the suction port.

Comparing to the prior art, some effective results of the embodiments are listed below:

an embodiment of the present disclosure provides a cleaning robot in which the brush body is configured to be of a structure comprising a plurality of brush portions and a soft bag, wherein the brush body is an elastic member, and the soft bag is an air bag or a hollow structure, such that during cleaning, the first cleaning assembly, with increased elastic expansion space, can adapt to clean floors of different materials, and thus a frictional force between the first cleaning assembly and a floor to be cleaned is reduced, and the service life of the first cleaning assembly is extended and scratches or damages to the floor are prevented.

The technical solutions in examples of the present disclosure are clearly described below with reference to the drawings in examples of the present disclosure. Apparently, the described examples are merely some of the embodiments of the present disclosure, rather than all the examples. Based on the examples in the present disclosure, all the other examples obtained by those of ordinary skills in the art without inventive efforts shall be covered by the protection scope of the present disclosure.

Words for orientation "front", "back", "left", and "right" described herein are referenced with respect to proceeding direction of the cleaning robot, and terms "top cover" and "chassis" described herein are referenced with respect to a status of the cleaning robot in a normal operation status.

First Embodiment

Figure 2:
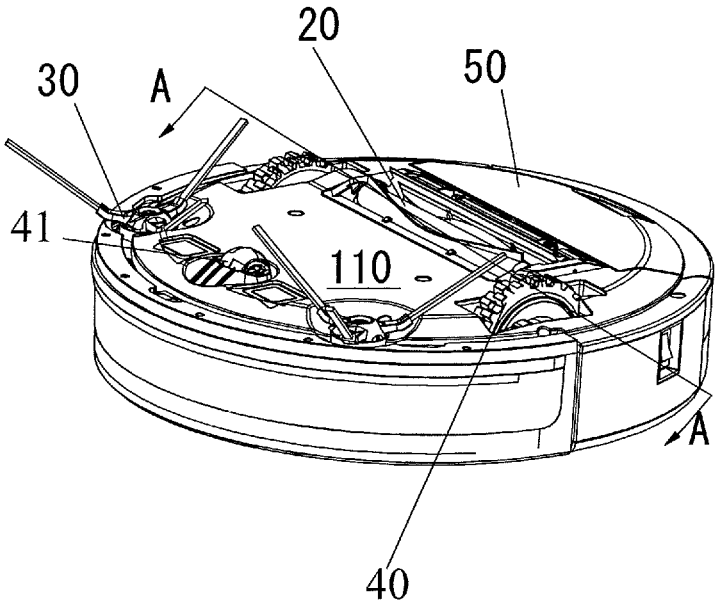
FIG. 2 is a bottom view of a cleaning robot in a first embodiment of the present disclosure.
Figure 3:
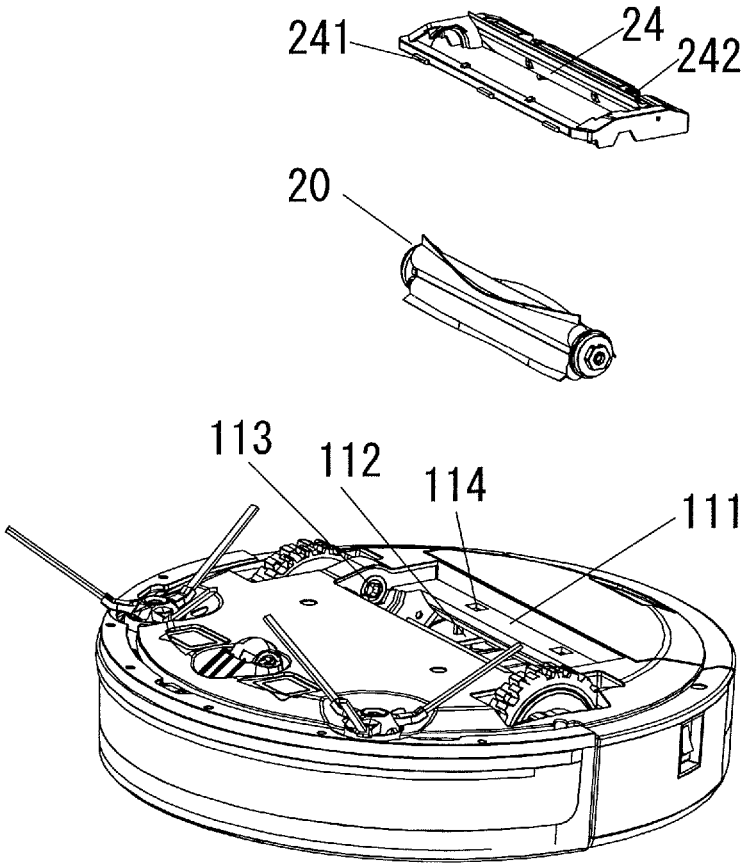
FIG. 3 is an exploded view of a cleaning robot in a first embodiment of the present disclosure.

Referring to FIG. 1, FIG. 2 and FIG. 3, FIG. 1 is a perspective view of a cleaning robot in an embodiment of the present disclosure, FIG. 2 is a bottom view of a cleaning robot in an embodiment of the present disclosure, and FIG. 3 is an exploded view of a cleaning robot in an embodiment of the present disclosure. In a first embodiment of the present disclosure, the outer shape of the cleaning robot is circular, and in other embodiments, the cleaning robot may be square, elliptical, triangular or of other shapes. The cleaning robot may include a body 10, wherein the body 10 includes a chassis 110, an upper cover 100 covered on the chassis 110, and an obstacle sensor system 60 provided at the front of the body 10, a cleaning object collecting box 50 detachably mounted to the body 10, a driving assembly 40 connected with the body 10 and driving the cleaning robot to move, an omnidirectional wheel 41 controlling the cleaning robot to flexibly steer, a first cleaning assembly 20 for cleaning a floor, and a second cleaning assembly 30 assisting the first cleaning assembly 20, and a controller (not shown in the figure) mounted inside the body 10 to control behavior of the cleaning robot.

In a first embodiment of the present disclosure, there may be a plurality of controllers, each of which is provided in the obstacle sensor system 60, the driving assembly 40, the first cleaning assembly 20, the second cleaning assembly 30, or other modules that need to be controlled by a controller. There also may be one controller which is provided in the body 10 of the cleaning robot to control other respective components of the cleaning robot to work. The controller may be a micro control unit for example a single chip microcomputer, an FPGA, an ASIC, or a DSP, etc.

In the present embodiment, the obstacle sensor system 60 is provided at the front of the body 10 of the cleaning robot, and includes a signal emitter and a signal receiver, and the controller determines position or distance information between the cleaning robot and the obstacle, and controls the cleaning robot to travel due to a signal received by the signal receiver, wherein the signal is emitted by the signal emitter and reflected by the obstacle. The signal emitter may be an infrared emitter, an ultrasonic generator, a laser emitter, and other devices capable of emitting a detection signal, and accordingly the signal receiver is an infrared receiver, an ultrasonic receiver, a laser receiver, and other signal receiver of a type corresponding to that of a signal emitted by the signal emitter.

In the present embodiment, the driving assembly 40 is configured to drive the cleaning robot to move on the floor, and the driving assembly 40 is mounted at both the left and right sides of the body 10, connected with the chassis 110, and at least partially protruded from the bottom of the chassis 110. The omnidirectional wheel 41 is mounted to the body 10 and forms a distribution of a triangle with the driving assembly 40 such that the cleaning robot is more stable during travelling. In other embodiments, the driving assembly 40 may be a crawler wheel or other devices mounted to the body 10 of the cleaning robot and bearing the body 10 of the cleaning robot for travelling. In other embodiments, the omnidirectional wheel 41 may be a Mecanum wheel or other devices which enable the cleaning robot to flexibly steer.

In the present embodiment, the cleaning object collecting box 50 is detachably mounted to the rear of the body 10 of the cleaning robot. In other embodiments, the cleaning object collecting box 50 may also be formed integrally with the cleaning robot in a non-detachable manner. In other embodiments, the cleaning object collecting box 50 may also be mounted at other positions of the cleaning robot. The cleaning object collecting box 50 is provided with an opening at a side close to the first cleaning assembly 20, and the opening is in communication with a suction port 112 provided in a cavity 111 of the chassis 110 through an air duct. The cleaning object collecting box 50 further includes a fan, and during the cleaning of the cleaning robot, the fan rotates to generate a strong suction force which sucks a cleaning object at the suction port 112 into the cleaning object collecting box 50, wherein the cleaning object may be dust, debris, garbage or other items thrown away by people.

In the present embodiment, the first cleaning assembly 20 is laterally mounted to the chassis 110. The wording "laterally" refers to being perpendicular to a proceeding direction of the cleaning robot. In other embodiments, there may be two first cleaning assemblies 20 obliquely mounted to the chassis 110 at an angle, wherein the two first cleaning assemblies 20 have ends on one side close to each other and ends on the other side away from each other to form a V-shape, and during cleaning, the two first cleaning assemblies 20 rotate towards inside of the V-shape to sweep the cleaning object to the suction port. The cleaning robot further includes a second cleaning assembly 30, and there is at least one second cleaning assembly 30. The second cleaning assembly 30 is mounted at an edge position of the chassis 110 for cleaning an edge of the obstacle or a corner that the first cleaning assembly 20 cannot clean, and directing the cleaning object to the first cleaning assembly 20.

The cleaning robot further includes a motor mounted inside the body 10, and the motor is communicated with the controller to power respective components of the cleaning robot to drive the respective components to move.

Figure 4:
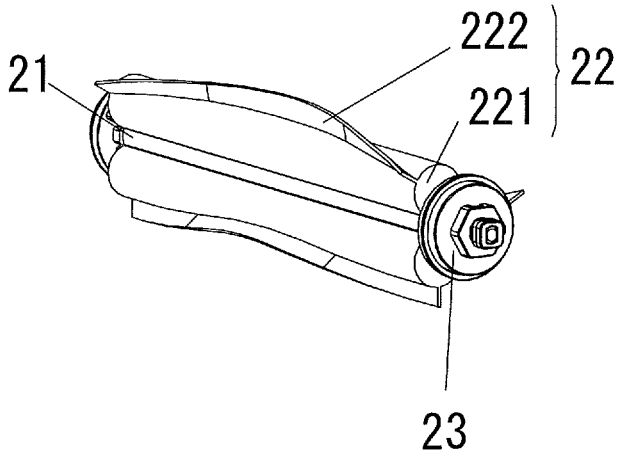
FIG. 4 is a schematic view of a first cleaning assembly in a first embodiment of the present disclosure.

Referring to FIG. 3 and FIG. 4, FIG. 3 is an exploded view of a cleaning robot in an embodiment of the present disclosure, and FIG. 4 is a schematic view of a first cleaning assembly in a first embodiment of the present disclosure. In a first embodiment of the present disclosure, the chassis 110 of the body 10 of the cleaning robot is provided with a cavity 111 in which the first cleaning assembly 20 is mounted, and the cavity 111 is provided with a suction port 112 at a side adjacent to the cleaning object collecting box 50, wherein the suction port 112 is in communication with the air duct, facilitating to suck the cleaning object pushed by the first cleaning assembly 20 to the suction port 112 into the cleaning object collecting box 50. The first cleaning assembly includes a rotating shaft 21, mounting members 23 mounted at both ends of the rotating shaft, and a brush body 22 provided outside the rotating shaft 21. Mounting grooves 113 are provided at both ends of the cavity 111, and a part of the outer wall of the mounting member 23 is fit with the mounting groove 113 when the first cleaning assembly 20 is mounted in the cavity 111.

The first cleaning assembly 20 may further include a positioning bracket 24, where the positioning bracket 24 is detachably mounted to the chassis 110 and surrounding the cavity 111, and both ends of the positioning bracket 24 are at least partially covered with the mounting members 23. One side of the positioning bracket 24 is provided with a positioning leg 241, the other side of the positioning bracket is provided with a hand clasp 242, and two sides of the cavity 111 are correspondingly provided with a positioning hole and a snap joint 114. The first cleaning assembly 20 is mounted in the cavity 111, the positioning leg 241 of the positioning bracket match with the positioning hole, and the hand clasp 242 is snap-fitted into the snap joint 114, such that the first cleaning assembly 20 is fastened to the chassis 110. When the first cleaning assembly 20 needed to be taken out, the first cleaning assembly 20 can be taken out from the chassis 110 by simply forcing the hand clasp 242 apart to unfold the positioning bracket 24.

Figure 5:
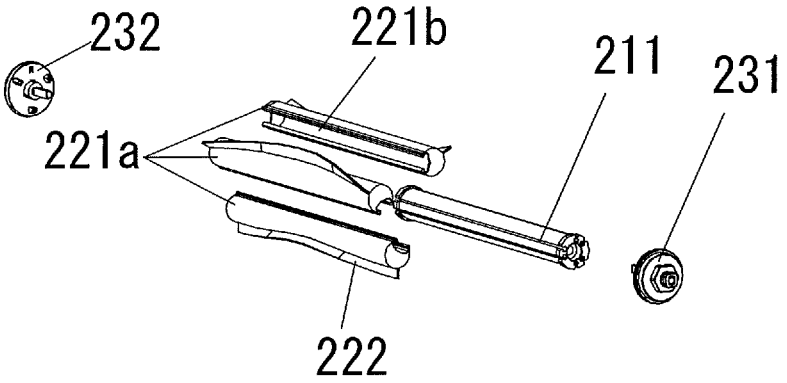
FIG. 5 is a structural disassembling view of a first cleaning assembly in a first embodiment of the present disclosure.
Figure 6:
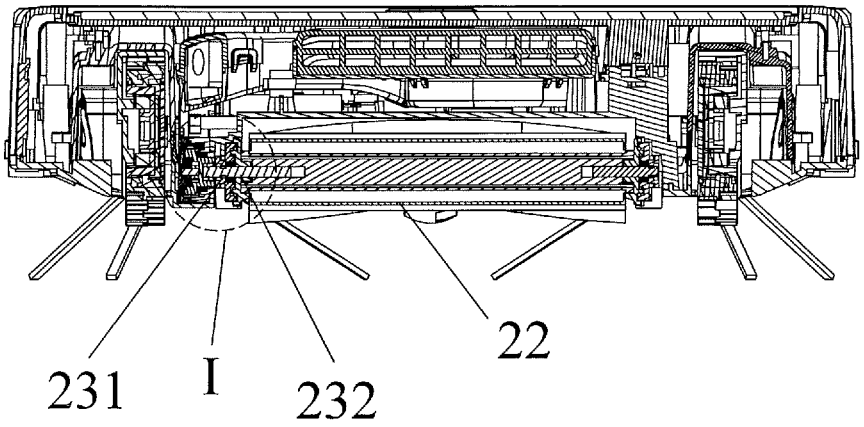
FIG. 6 is a cross-sectional view of the cleaning robot taken along with line A-A of FIG. 2 in a first embodiment of the present disclosure.
Figure 7:
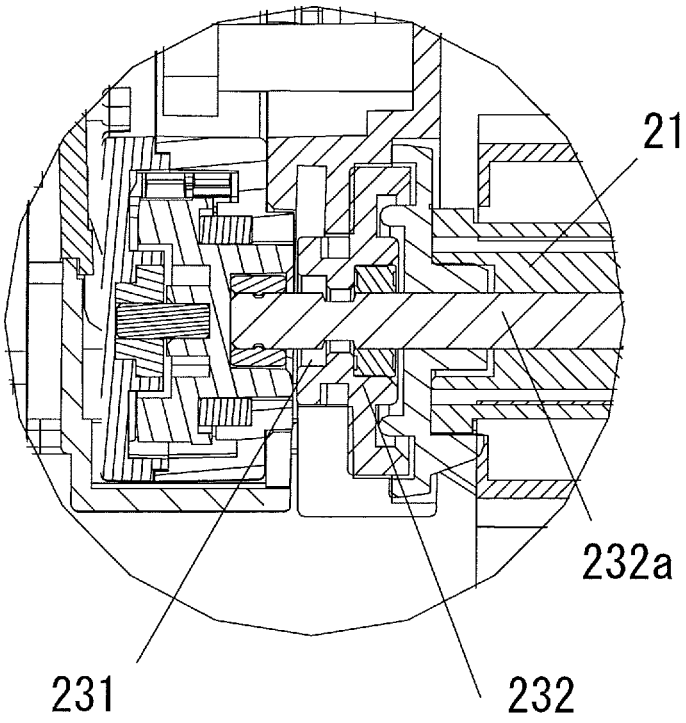
FIG. 7 is a partially enlarged view of part I in FIG. 6.

Referring to FIG. 4, FIG. 5, FIG. 6 and FIG. 7, FIG. 4 is a schematic view of a first cleaning assembly in a first embodiment of the present disclosure; FIG. 5 is a structural disassembling view of a first cleaning assembly in a first embodiment of the present disclosure; FIG. 6 is a cross-sectional view of the cleaning robot taken along line A-A of FIG. 2 in a first embodiment of the present disclosure; and FIG. 7 is a partially enlarged view of part I in FIG. 6. In a first embodiment of the present disclosure, the first cleaning assembly 20 includes a rotating shaft 21, mounting members 23 mounted at both ends of the rotating shaft 21, and a brush body 22 provided outside the rotating shaft 21. The brush body 22 is made of an elastic material, which may be a thermoplastic polyurethane (TPU) foam, vinyl acetate (EVA) or polypropylene foam, and in some embodiments, the brush body 22 may be permanently fixed to the rotating shaft 21, and is integrally formed with the rotating shaft 21 to prevent the brush body 22 from being separated from the rotating shaft 21 during cleaning.

The brush body 22 is detachably mounted to the rotating shaft 21. The brush body 22 includes a plurality of brush portions 222 and a soft bag 221, the plurality of brush portions 222 are blades extending outward from an outer surface of the soft bag 221, and the brush portions 221 are integrally formed with the soft bag 221. In one embodiment, the shape of the brush portion 221 is a V shape, and the brush portion 222 contacts with the floor alternately and continuously during cleaning, ensuring the air tightness of the suction port 112 during cleaning, improving cleaning effects, and enabling to prevent the first cleaning assembly 20 from being wounded by hairlike substance. In other embodiments, the shape of the brush portion 222 may be a linear shape or other curved shapes.

The soft bag 221 may include a plurality of bag portions 221*a*, each of the bag portions 221*a* is combined with one of the brush portions 222. Each of the bag portions 221*a* is provided with an opening 221*b*, at least a part of the edge of the opening 221*b* is further provided with a protrusion, the rotating shaft 21 is provided with a channel 211, and the protrusion matches with the channel 211 to mount the bag portion 221*a* to the rotating shaft 21. For example, the cross section of the channel 211 may be of a T shape, and accordingly, the cross section of the protrusion may be provided to be an inverted T shape, and by snap-fitting the protrusion with the inverse T shape into the channel 211 with a cross section of a T shape, the bag portion 221*a* is fixed to the rotating shaft 21, such that the soft bag 221 and the rotating shaft 21 form an integral unit that is detachable. In case of mounting, one end of the protrusion may be compelled to slide from one end of the channel 211 to the other end of the channel 211, thereby mounting the bag portion 221*a* to the rotating shaft 21. In the present embodiment, a cross section of the channel 211 is of a T shape, and in other embodiments, the cross section of the channel may be of any shape with a notch. In other embodiments, one of the bag portions 221*a* may be combined with a plurality of brush portions 222. In other embodiments, the bag portion 221*a* may be a closed air bag or a closed hollow structure, and an outer surface of the bag portion 221*a* is provided with a protrusion, wherein the protrusion matches with the channel 211, and the bag portion 221*a* is fixed to the rotating shaft 21, such that the soft bag 22 is integrally formed with the rotating shaft 21.

The bag portion 221*a* may be a closed air bag or other closed hollow structures, and such an arrangement can be adapted to clean different floors while ensuring a cleaning effect. For example, when the floor is a thin short-haired carpet, there is a small frictional force between the bag portion 221*a* and the thin short-haired carpet, the bag portion 221*a* is subjected to a small pressing force, and a slight deformation of the bag portion 221*a* can push the cleaning object to the suction port 112. When the floor is a thick carpet or a long-haired carpet, there in an increased frictional force between the bag portion 221*a* and the thick carpet or the long-haired carpet; however, not only the elastic space of the bag portion 221*a* is increased, but also the material itself has elasticity, such that the frictional force between the bag portion 221*a* and the thick carpet or the long-haired carpet can be effectively alleviated, and the temperature between contact surfaces of the bag portion 221*a* and the thick carpet or the long-haired carpet is reduced when cleaning. On the one hand, damage to the thick carpet or the long-haired carpet can be reduced, and on the other hand, wear and tear on the bag portion 221*a* can be reduced, and the service life of the first cleaning assembly 20 can be extended. When the floor is other hard floor, the bag portion 221*a* is subjected to an increased pressing force, the elastic space of the bag portion 221*a* is large, and the bag portion 221*a* is made of an elastic material, such that the hard floor can be protected effectively, and scratches or damages to the hard floor can be prevented.

The mounting member 23 includes a fixing member 231 and a transmission member 232, the transmission member 232 further includes a transmission shaft 232*a*, one end of the transmission shaft 232*a* is sleeved with the fixing member 231, and is further connected with the motor inside the body of the cleaning robot, and the other end is connected with the rotating shaft 21. The fixing member 231 is made of an elastic material, and vibration can be reduced, and noise during running of the cleaning robot can be reduced while the first cleaning assembly 20 is fixedly mounted.

In the present embodiment, the first cleaning assembly of the cleaning robot includes a rotating shaft 21, mounting members 23 mounted at both ends of the rotating shaft, and a brush body 22 provided outside the rotating shaft 21. The brush body 22 includes a plurality of brush portions 222 and a soft bag 221, the plurality of brush portions 222 are blades extending outward from an outer surface of the soft bag 221, and the brush portion 222 is integrally formed with the soft bag 221. The soft bag 221 includes a plurality of bag portions 221*a*, the bag portions 221*a* are air bags or of internal hollow structures, and the brush body 22 is an elastic member. Therefore, during cleaning, no matter the floor to be cleaned is a hard floor, a thin short-haired carpet, a thick carpet or a long-haired carpet, when the bag portion 221*a* is pressed, the elastic space is increased, the frictional force between the bag portion 221*a* and the floor to be cleaned can be reduced, and the temperature between the contact surfaces can be reduced. The service life of the first cleaning assembly 20 is extended while floors of different materials to be cleaned can be protected effectively.

Second Embodiment

Figure 8:
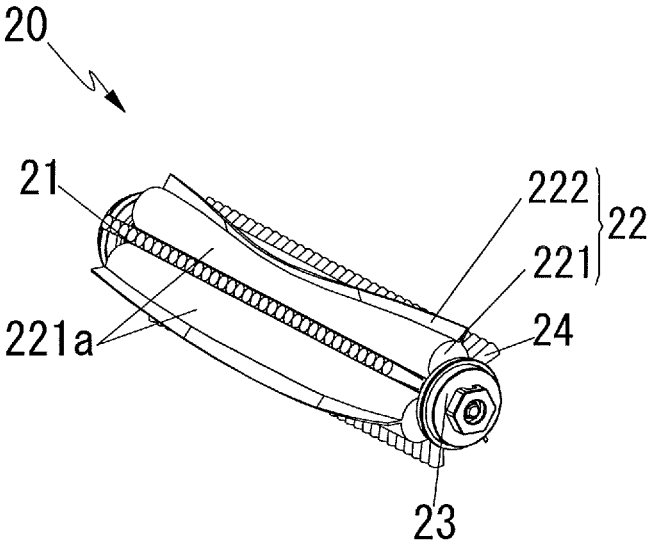
FIG. 8 is a schematic view of a first cleaning assembly in a second embodiment of the present disclosure.

Referring to FIG. 8, FIG. 8 is a schematic view of a first cleaning assembly in a second embodiment of the present disclosure. The structure of the cleaning robot provided by the second embodiment and the function thereof are substantially the same as the structure of the cleaning robot described in the first embodiment and the function thereof. The difference is that in the second embodiment, the first cleaning assembly 20 includes a rotating shaft 21, mounting members 23 mounted at both ends of the rotating shaft 21, and a brush body 22 and a bristle 24 provided outside the rotating shaft. The brush body 22 and the bristle 24 each are made of an elastic material, the brush body 22 includes a plurality of brush portions 222 and a soft bag 221, the soft bag 221 includes a plurality of bag portions 221*a*, the bag portions 221*a* are air bags or other hollow structures, the plurality of bag portions 221*a* are not connected to each other; and in other embodiments, the plurality of bag portions 221*a* may in communication with each other. At least one brush portion 222 is extended outwardly from each of the bag portions 221*a*, and the bag portion 221*a* is integrally formed with the brush portion 222. The surface of the rotating shaft 21 is provided with a plurality of channels for mounting the brush body 22 and a plurality of slots for mounting the bristle 24, and the plurality of channels and the plurality of slots are alternately distributed on the rotating shaft 21 such that the brush body 22 and the bristle 24 are alternately mounted to the rotating shaft.

In the present embodiment, the first cleaning assembly 20 of the cleaning robot includes a rotating shaft 21, mounting members 23 mounted at both ends of the rotating shaft 21, and a brush body 22 and a bristle 24 provided outside the rotating shaft. The brush body 22 and the bristle 24 are alternately mounted on the rotating shaft. During cleaning, the bristle 24 sweeps large particles to the suction port, and the brush body 22 further pushes dust and other fine particles to the suction port, wherein the brush body 22 is an elastic body, and the bag portion 221*a* of the brush body 22 is of a hollow structure, the elastic space is increased, and thus the frictional force between the bag portion 221*a* and the floor to be cleaned can be reduced, and the temperature between the contact surfaces can be reduced. The service life of the first cleaning assembly 20 is extended while floors of different materials to be cleaned can be protected effectively, and there is a certain cleaning effect.

Third Embodiment

Figure 9:
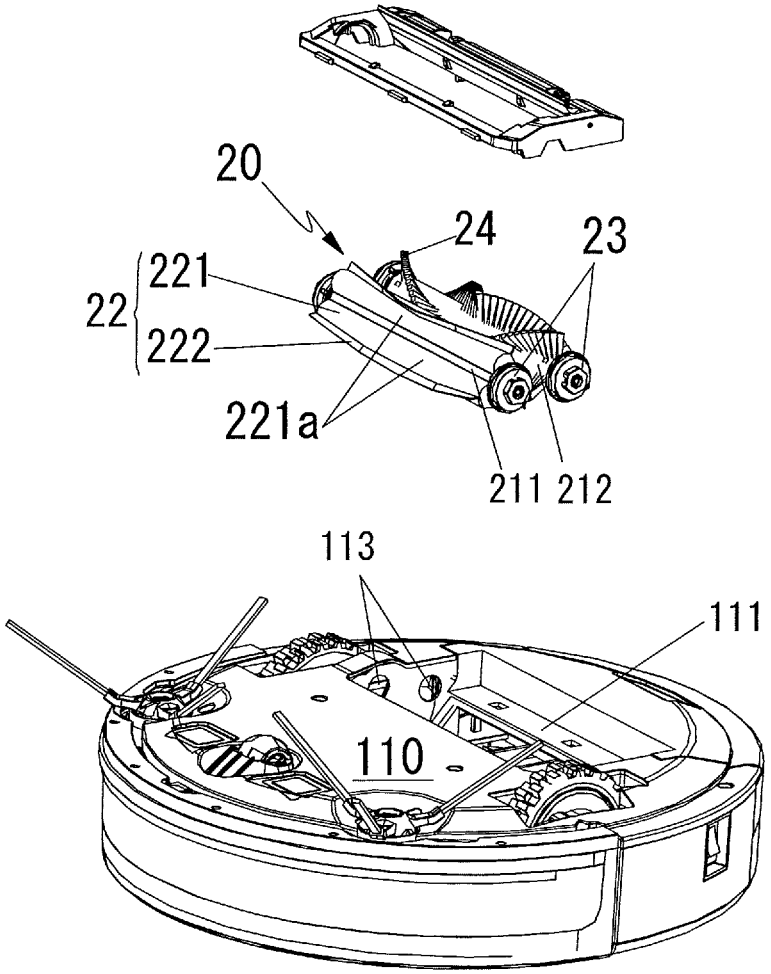
FIG. 9 is an exploded view of a cleaning robot in a third embodiment of the present disclosure.

Referring to FIG. 9, FIG. 9 is an exploded view of a cleaning robot in a third embodiment of the present disclosure. The structure of the cleaning robot provided by the third embodiment and the function thereof are substantially the same as the structure of the cleaning robot described in the first embodiment and the function thereof. The difference is that in the third embodiment, the first cleaning assembly 20 includes a first rotating shaft 211, a second rotating shaft 212, mounting members 23 mounted at both ends of the first rotating shaft 211 and the second rotating shaft 212, and a brush body 22 provided at the first rotating shaft 211 and a bristle 24 provided at the second rotating shaft 212. The brush body 22 may also be provided at the second rotating shaft 212, and accordingly the bristle 24 may also be provided at the first rotating shaft 211, and the first rotating shaft 211 and the second rotating shaft 212 both may be provided with the brush body 22.

The brush body 22 and the bristle 24 each are made of an elastic material, the brush body 22 includes a plurality of brush portions 222 and a soft bag 221, the soft bag 221 includes a plurality of bag portions 221*a*, the bag portions 221*a* are air bags or other hollow structures, the plurality of bag portions 221*a* are not connected to each other; at least one brush portion 222 is extended outwardly from each of the bag portions 221*a*, and the bag portion 221*a* is integrally formed with the brush portion 222. The surface of the first rotating shaft 211 is provided with a channel for mounting the brush body 22 and a surface of the second rotating shaft 212 is provided with a slot for mounting the bristle 24, such that the brush body 22 and the bristle 24 are fixed to the first rotating shaft 211 and the second rotating shaft 212, respectively. The chassis 110 of the body of the cleaning robot is provided with a cavity 111, and mounting grooves 113 are provided side by side at both ends of the cavity 111 such that the first rotating shaft 211 and the second rotating shaft 212 are mounted side by side in the cavity 111. During cleaning, two rotating shafts rotate, and the bristle 24 and the brush body 22 sweep across the floor in an alternative and circular manner, sweep the cleaning object on the floor to the suction port.

In the present embodiment, the first cleaning assembly 20 of the cleaning robot includes a first rotating shaft 211, a second rotating shaft 212, mounting members 23 mounted at both ends of the first rotating shaft 211 and the second rotating shaft 212, and a brush body provided at one of the two rotating shafts and a bristle provided at the other of the two rotating shafts. During cleaning, the two rotating shafts rotate, and the bristle 24 and the brush body 22 travel across the floor in an alternative and circular manner and sweep the cleaning object on the floor to the suction port. The brush body 22 is an elastic body, and the bag portion 221*a* of the brush body 22 is of a hollow structure, the elastic space is increased, the frictional force between the bag portion 221*a* and the floor to be cleaned can be reduced, and the temperature between the contact surfaces can be reduced. The service life of the first cleaning assembly 20 is extended while floors of different materials to be cleaned can be protected effectively, and there is certain cleaning effect.

Fourth Embodiment

Figure 10:
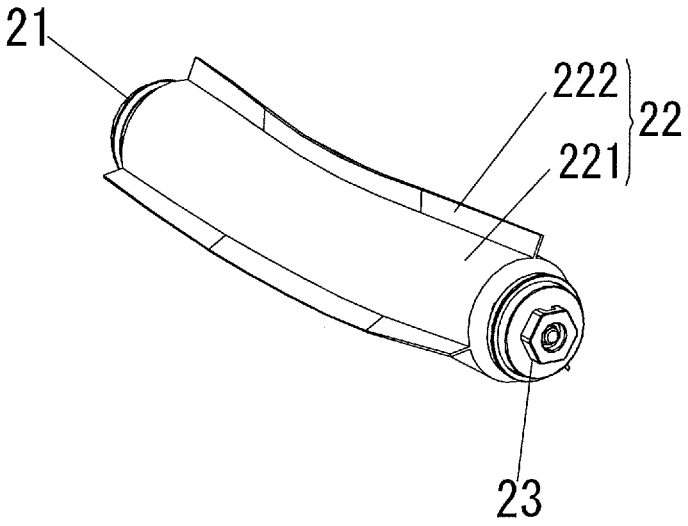
FIG. 10 is a schematic view of a first cleaning assembly in a fourth embodiment of the present disclosure.

Referring to FIG. 10, FIG. 10 is a schematic view of a first cleaning assembly in a fourth embodiment of the present disclosure. The structure of the cleaning robot provided by the fourth embodiment and the function thereof are substantially the same as the structure of the cleaning robot described in the first embodiment and the function thereof. The difference is that in the fourth embodiment, the first cleaning assembly 20 includes a rotating shaft 21, mounting members 23 mounted at both ends of the rotating shaft 21, and a brush body 22 provided outside the rotating shaft. The brush body 22 is made of an elastic material, and the brush body 22 includes a plurality of brush portions 222 and a soft bag 221, and the soft bag 221 is mounted outside the rotating shaft 21, with a hollow structure formed inside. At least one brush portion 222 is extended outwardly from the surface of the soft bag 221, and the soft bag 221 is integrally formed with the brush portion 222. The mounting members 23 are mounted at both ends of the rotating shaft 21, for sealing and fixing the soft bag 221 to the rotating shaft 21 on the one hand, and for connecting the motor inside the cleaning robot on the other hand, such that the first cleaning assembly 20 rotates to clean the floor.

In the present embodiment, the first cleaning assembly 20 of the cleaning robot includes a rotating shaft 21, mounting members 23 mounted at both ends of the rotating shaft 21, and a brush body 22 provided outside the rotating shaft. The brush body 22 includes a plurality of brush portions 222 and a soft bag 221, wherein a hollow structure is formed inside the soft bag 221. During cleaning, the brush portion 222 cleans the floor, the soft bag 221 has a large elastic space, and the soft bag 221 may be appropriately deformed according to different force conditions of the brush portion 222 when floors of different materials are cleaned, ensuring the sealing performance at the suction port and improving the cleaning effect while floors of different materials to be cleaned are protected effectively.

In the description of the specification of the present disclosure, the terms "one embodiment", "some embodiments", "an example", "a specific example", or "an alternative embodiment", etc., means that a particular feature, structure, material or characteristic described in connection with the embodiment or example is included in at least one embodiment or example of the present disclosure. In the specification of the present disclosure, the indicative representation of the above terms does not necessarily refer to the same embodiments or examples. Moreover, the description of the specific characteristic, structure, material, or feature can be combined in an appropriate manner in any one or more embodiments or examples.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

The invention claimed is:

1. A cleaning robot, comprising:

a body;

a driving assembly provided in the body and configured for driving the cleaning robot to move;

a cleaning object collecting box mounted in the body, in communication with a suction port of the body, and configured for collecting a cleaning object; and a first cleaning assembly mounted in the body and configured for cleaning a floor;

wherein the first cleaning assembly comprises a rotating shaft, mounting members mounted at two ends of the rotating shaft, and a brush body provided outside the rotating shaft, wherein the brush body comprises a brush portion and a soft bag, wherein the soft bag is deformable according to a force condition of the brush portion, and the rotating shaft is rotatable along with rotation of the mounting members, driving the brush body to sweep the cleaning object on the floor to the suction port.

2. The cleaning robot according to claim 1, wherein the brush portion comprises a plurality of brush portions, and the soft bag is provided between the brush portions and the rotating shaft.

3. The cleaning robot according to claim 2, wherein the soft bag is any one of an air bag and an internal hollow structure.

4. The cleaning robot according to claim 2, wherein the plurality of brush portions are blades extending outward from an outer surface of the soft bag, and the soft bag is formed integrally with the plurality of brush portions.

5. The cleaning robot according to claim 2, wherein the soft bag comprises a plurality of bag portions, and each of the bag portions is combined with at least one brush portion of the brush portions.

6. The cleaning robot according to claim 5, wherein each of the bag portions is provided with an opening, a surface of the rotating shaft is provided with a channel, and the each of the bag portions is combined with the channel of the rotating shaft through at least partial edge of the opening, such that the soft bag and the rotating shaft form into one piece.

7. The cleaning robot according to claim 6, wherein the channel is of a linear type, an oblique type or a curved type, and an outer shape of the soft bag is a linear shape, an oblique shape or a curved shape after the opening of the corresponding bag portion cooperates with the channel.

8. The cleaning robot according to claim 6, wherein each of the mounting members comprises a fixing member and a transmission member, the fixing member is sleeved at one end of the transmission member, and the end of the transmission member sleeved with the fixing member is connected with a motor mounted inside the body, and the other end of the transmission member is connected with the rotating shaft to drive the first cleaning assembly to rotate to clean the floor.

9. The cleaning robot according to claim 5, wherein the plurality of bag portions are connected or not connected with each other.

10. The cleaning robot according to claim 9, wherein the brush body is an elastic member.

11. The cleaning robot according to claim 9, wherein each of the mounting members comprises a fixing member and a transmission member, the fixing member is sleeved at one end of the transmission member, and the end of the transmission member sleeved with the fixing member is connected with a motor mounted inside the body, and the other end of the transmission member is connected with the rotating shaft to drive the first cleaning assembly to rotate to clean the floor.

12. The cleaning robot according to claim 5, wherein the brush body is an elastic member.

13. The cleaning robot according to claim 5, wherein each of the mounting members comprises a fixing member and a transmission member, the fixing member is sleeved at one end of the transmission member, and the end of the transmission member sleeved with the fixing member is connected with a motor mounted inside the body, and the other end of the transmission member is connected with the rotating shaft to drive the first cleaning assembly to rotate to clean the floor.

14. The cleaning robot according to claim 2, wherein the brush body is an elastic member.

15. The cleaning robot according to claim 2, wherein each of the mounting members comprises a fixing member and a transmission member, the fixing member is sleeved at one end of the transmission member, and the end of the transmission member sleeved with the fixing member is connected with a motor mounted inside the body, and the other end of the transmission member is connected with the rotating shaft to drive the first cleaning assembly to rotate to clean the floor.

16. The cleaning robot according to claim 1, wherein the brush body is an elastic member.

17. The cleaning robot according to claim 1, wherein each of the mounting members comprises a fixing member and a transmission member, the fixing member is sleeved at one end of the transmission member, and the end of the transmission member sleeved with the fixing member is connected with a motor mounted inside the body, and the other end of the transmission member is connected with the rotating shaft to drive the first cleaning assembly to rotate to clean the floor.

18. A cleaning robot, comprising:

a body;

a driving assembly provided in the body and configured for driving the cleaning robot to move;

a cleaning object collecting box mounted in the body, in communication with a suction port of the body, and configured for collecting a cleaning object; and a first cleaning assembly mounted in the body and configured for cleaning a floor, wherein the first cleaning assembly comprises a rotating shaft, mounting members mounted at two ends of the rotating shaft, and a brush body and a bristle provided outside the rotating shaft, the brush body comprises a brush portion and a soft bag, wherein the soft bag is deformable according to a force condition of the brush portion, and the rotating shaft is rotatable along with rotation of the mounting members, driving the brush body and the bristle to sweep the cleaning object on the floor to the suction port.

19. The cleaning robot according to claim 18, wherein the soft bag is provided between the brush portion and the rotating shaft, a surface of the rotating shaft is provided with a channel configured for mounting the brush body and a slot configured for mounting the bristle, and the channel and the slot are provided side by side such that the brush body and the bristle are mounted side by side into the rotating shaft.

20. A cleaning robot, comprising:

a body;

a driving assembly provided in the body and configured for driving the cleaning robot to move;

a cleaning object collecting box mounted in the body, in communication with a suction port of the body, and configured for collecting a cleaning object; and a first cleaning assembly mounted in the body and configured for cleaning a floor, wherein the first cleaning assembly comprises a first rotating shaft, a second rotating shaft, mounting members mounted at two ends of the first rotating shaft and the second rotating shaft, and a brush body provided in one of the two rotating shafts and a bristle provided in the other one of the two rotating shafts, the brush body comprises a brush portion and a soft bag, the soft bag is deformable according to a force condition of the brush portion, and the rotating shaft is rotatable along with rotation of the mounting members, driving the brush body and the bristle to sweep a cleaning object on the floor to the suction port.

* * * * *